US006231627B1

(12) United States Patent
Reeves et al.

(10) Patent No.: US 6,231,627 B1
(45) Date of Patent: May 15, 2001

(54) METHOD TO REDUCE OXIDATIVE DETERIORATION OF BULK MATERIALS

(75) Inventors: Robert A. Reeves, Arvada; Charlie W. Kenney, Littleton; Mark H. Berggren, Golden, all of CO (US)

(73) Assignee: Hazen Research, Inc., Golden, CO (US)

( * ) Notice: Subject to any disclaimer, the term of this patent is extended or adjusted under 35 U.S.C. 154(b) by 0 days.

(21) Appl. No.: 09/220,271

(22) Filed: Dec. 22, 1998

Related U.S. Application Data

(63) Continuation-in-part of application No. 08/995,710, filed on Dec. 22, 1997, which is a continuation-in-part of application No. 08/667,637, filed on Jul. 8, 1996, now Pat. No. 5,725, 613.

(51) Int. Cl.[7] ..... C10L 5/00

(52) U.S. Cl. ..... 44/620; 44/501; 44/591; 44/592

(58) Field of Search ..... 44/501, 591, 592, 44/620

(56) References Cited

U.S. PATENT DOCUMENTS

| | | | | |
|---|---|---|---|---|
| Re. 33,788 | | 1/1992 | Clay | 149/1 |
| 3,243,889 | | 4/1966 | Ellman et al. | 34/9 |
| 3,957,456 | | 5/1976 | Verschuur | 44/10 E |
| 3,969,124 | | 7/1976 | Stewart | 106/56 |
| 4,083,940 | | 4/1978 | Das | 44/620 |
| 4,170,456 | | 10/1979 | Smith | 44/1 |
| 4,186,054 | | 1/1980 | Brayton et al. | 201/6 |
| 4,257,848 | | 3/1981 | Brayton et al. | 202/82 |
| 4,304,636 | | 12/1981 | Kestner et al. | 201/20 |
| 4,396,394 | | 8/1983 | Li et al. | 44/1 |
| 4,401,436 | | 8/1983 | Bonnecaze | 44/1 |
| 4,450,046 | | 5/1984 | Rice et al. | 201/20 |
| 4,511,363 | | 4/1985 | Nakamura et al. | 44/501 |
| 4,599,250 | | 7/1986 | Cargle et al. | 427/220 |
| 4,613,429 | | 9/1986 | Chiang et al. | 209/5 |
| 4,650,495 | | 3/1987 | Yan | 44/1 |
| 4,759,772 | * | 7/1988 | Rogers et al. | 44/501 |
| 4,778,482 | * | 10/1988 | Bixel et al. | 44/501 |
| 4,797,136 | | 1/1989 | Siddoway et al. | 44/501 |
| 4,828,575 | | 5/1989 | Bellow, Jr. et al. | 44/501 |
| 4,828,576 | | 5/1989 | Bixel et al. | 44/501 |
| 4,957,596 | | 9/1990 | Ukita et al. | 201/20 |
| 5,087,269 | | 2/1992 | Cha et al. | 44/501 |
| 5,124,162 | | 6/1992 | Bošković et al. | 426/96 |
| 5,435,813 | | 7/1995 | Evans | 44/620 |
| 5,609,458 | | 3/1997 | Hanaoka et al. | 414/173 |
| 5,795,856 | | 8/1998 | Hatano et al. | 510/444 |
| 5,919,277 | * | 7/1999 | Reeves | 44/501 |
| 5,968,891 | | 10/1999 | Mallari et al. | 510/444 |

OTHER PUBLICATIONS

Standish et al., "Optimization of Coal Grind for Maximum Bulk Density," *Powder Technology*, vol. 68, 1991, pp. 175–186.

Furnas, C.C., "Flow of Gases Through Beds of Broken Solids," United States Department of Commerce, Bureau of Mines, Bulletin 307, pp. 74–83, 1929.

Furnas, C.C., "Grading Aggregates—Mathematical Relations for Beds of Broken Solids of Maximum Density," *Industrial and Engineering Chemistry*, vol. 23, No. 9, pp. 1052–1058, 1931.

Edwards, 1995, Catalysis Today, 23: 59–66.

Keim, "Industrial Uses of *Carbon Dioxide", in Carbonoxide as a Source of Carbon*, M. Aresta and G. Forti, eds., D. Reidel Publidhing Co., 1987, 23–31.

Rigsby et al., "Coal Self–Heating Promblems and Solutions", pp. 102–106.

Riley et al., J. Coal Quality, Apr. 1987, pp. 64–67.

Ripp. "Understanding Coal Pile Hydrology can help BTU loss in stored coal", pp. 146–150.

Sapienze et al., "Carbon Dioxide/Water for Coal Beneficiation", in *Mineral Matter and Ash in Coal*, 1986 American Chemical Society, pp. 500–512.

* cited by examiner

*Primary Examiner*—Margaret Medley
*Assistant Examiner*—Cephia D. Toomer
(74) *Attorney, Agent, or Firm*—Sheridan Ross P.C.

(57) ABSTRACT

A method and composition are disclosed to reduce the oxidative deterioration of bulk materials. Preferred embodiments of bulk materials include solid fuel materials, such as coal, and bulk food products. The method includes sizing a bulk material so that it has a porosity of 40% or less. This relatively low porosity reduces the surface area of the bulk material available to the ambient environment for oxidation. The method of sizing the bulk material may be combined with the step of contacting the bulk material with an inert gas or a heat transfer medium.

42 Claims, No Drawings

METHOD TO REDUCE OXIDATIVE DETERIORATION OF BULK MATERIALS

RELATED APPLICATIONS

This application is a continuation-in-part application of U.S. patent application Ser. No. 08/995,710 filed on Dec. 22, 1997, which is a continuation-in-part of U.S. patent application Ser. No. 08/667,637 filed on Jul. 8, 1996, now U.S. patent application Ser. No. 5,725,613, both of which are incorporated herein by reference.

FIELD OF THE INVENTION

The present invention relates to a method and composition for reducing the oxidative deterioration of bulk materials. In particular, the invention relates to the reduction of oxidative deterioration of solid fuel materials, such as coal.

BACKGROUND OF THE INVENTION

When bulk materials contact the ambient environment, they are subject to oxidative deterioration because of contact with oxygen and air. Such oxidative deterioration can have many negative effects. For example, when a solid fuel material, such as coal, is being transported from a mine to a utility or is in storage at a utility, it is subject to oxidation. One negative aspect of such oxidative deterioration is a loss in the thermal value of the coal. Depending upon the type of coal and its water content, among other factors, between 1% and 5% of the thermal value of coal can be lost from the time it is mined until the time at which it is consumed. These losses are sizeable in the domestic United States utility industry, which consumes about 800 million tons of coal per year. Such losses are particularly significant for low rank coals such as lignite and sub-bituminous coals, especially for such materials which have been upgraded by thermal treatment to reduce moisture. Moreover, low level oxidation of coal generates heat. As a result, there is a significant risk of certain coal materials self-igniting, resulting in a risk to property and life.

Most efforts to reduce oxidative deterioration have focused on reducing the risk of self-heating and thereby self-ignition of coals. The problem has been addressed by a variety of approaches. One such approach is by compacting coal as it is transported or stored. By compacting coal, the surface area of the coal that is in contact with the ambient environment can be reduced. Such a reduction of surface area contact reduces the amount of coal available for oxidation by the ambient environment. Another approach has been to flatten and trim coal piles to decrease the ability of the coal pile to hold heat and therefore generate enough heat through self-heating to self-ignite. In addition, contacting coal materials with various fluids, such as hydrocarbon based materials, has been used.

While the more chronic problem of loss of economic value of bulk materials, such as the loss of heating values in coal, has been recognized and studied, adequate widespread use of strategies for significantly reducing economic losses from this problem have not been achieved. Therefore, a need exists for reducing the oxidative deterioration of bulk materials.

SUMMARY OF THE INVENTION

The present invention includes a method to reduce oxidative deterioration of bulk materials, particularly including oxidizable and highly reactive bulk materials. In preferred embodiments, the bulk materials in question include solid fuel materials, bulk food products, sulfide ores and carbon-containing materials such as activated carbon and carbon black. In further preferred embodiments, the solid fuel material can be coal, upgraded coal products, oil shale, solid biomass materials, refuse derived (including municipal and reclaimed refuse) fuels, coke, char, petroleum coke, gilsonite, distillation byproducts, wood byproduct waste, shredded tires, peat and waste pond coal fines.

The method includes preparing a first amount of the bulk material in a first size, and preparing a second amount of the bulk material in a second size. These two size fractions are then combined. The proportions in which the first and second sizes are combined is controlled so that the resulting porosity of the combination of the bulk material is about 40% or less. By reducing the porosity from what might otherwise be present after the preparation of the bulk material, the surface area of the bulk material in contact with the ambient environment is reduced. This then reduces the amount of bulk material available to the ambient environment for oxidation. In addition to the reduced surface area, the reduced porosity provided by this method inhibits the rate at which gas may flow through the bulk material. This reduced gas flow also limits the oxidative deterioration of the bulk material by reducing the amount of oxygen available to the bulk material for oxidation. A further benefit of the disclosed method is that the reduction in porosity also results in an increase in the density of the bulk material, thereby reducing the volume of the bulk material that must be handled and stored for a given tonnage of the bulk material.

The steps of preparing amounts of the bulk material in two different sizes may be accomplished through a variety of methods. Such methods may include crushing or grinding or pelletizing the bulk material. In a preferred embodiment of the present invention, the bulk material is crushed to a particle size of 2 inches or less. A first fraction of the crushed material, ranging in particle size from about ½ inch to about 2 inches particle size, is recovered. Separately, a second fraction of less than 4 mesh particle size is recovered, as is a third fraction of about ½ inch to about 4 mesh particle size. The first and second fractions are reserved while the third size fraction is further crushed to about less than 4 mesh particle size. The first, second and third size fractions are then combined, resulting in a bulk material having a porosity of 40% or less.

In a further embodiment of the present invention, a bulk material having a porosity of 40% or less is prepared as described in the above-mentioned embodiments. This bulk material is then aggregated into a storage pile until the bulk material is ready for use. This method of storing a bulk material results in lower rates of oxidative deterioration than might otherwise be achieved.

In addition, the present invention includes a bulk material that may be produced as described in the disclosed method. Such material will have a porosity of 40% or less, gained by the bi-modal particle size distribution achieved by the described method. In further embodiments, the method may include contacting the prepared bulk material with an inert gas or heat transfer medium. When the bulk material is aggregated into a storage pile, contacting the bulk material with an inert gas or heat transfer medium may include the step of adjusting the density of the gas or heat transfer medium, so that the gas or heat transfer medium remains in contact with the bulk material in the storage pile for the maximum amount of time.

DETAILED DESCRIPTION

The present invention concerns a method to reduce oxidative deterioration of bulk materials, and bulk materials prepared according to the disclosed method. The term "bulk materials" refers to any solid materials which are produced, shipped and/or stored in quantities that are generally measured on a tonnage basis, and preferably includes oxidizable and highly reactive materials. Bulk materials can include solid fuel materials, bulk food products, sulfide ores and carbon containing materials, such as activated carbon and carbon black.

Solid fuel material, as used herein, generally refers to any solid material that is combusted for some useful purpose. More particularly, solid fuel materials can include coal, upgraded coal products, and other solid fuels. The term "coal" includes anthracite, bituminous coal, sub-bituminous coal and lignite. The present invention is particularly suited for bituminous coal, sub-bituminous coal and lignite. The term "upgraded coal products" includes thermally upgraded coal products, coal products produced by beneficiation based upon specific gravity separation, mechanically cleaned coal products, and coal products such as stoker, breeze, slack and fines. The present invention is particularly suited for thermally upgraded coal because of significantly increased risk of oxidative deterioration and/or self-ignition. Thermally upgraded products are likely to have a higher rate of oxidation because of formation of reactive components which increase the rate of oxidation. In addition, such materials typically have had water removed to a significant extent. If such materials are subsequently exposed to humid environments, the materials will re-wet, thereby generating heat through the heat of hydration.

Examples of other solid fuels embodied in the present invention include, but are not limited to, oil shale, solid biomass materials, refuse derived (including municipal and reclaimed refuse) fuels, coke, char, petroleum coke, gilsonite, distillation byproducts, wood byproduct waste, shredded tires, peat and waste pond coal fines. The term "solid biomass" can include, for example, wood waste, agricultural waste, and grass. The term "refuse derived fuels" can include, for example, landfill material from which non-combustible materials have been removed.

In an embodiment of the present invention, bulk materials include bulk food products. Such bulk food products include food products that tend to deteriorate in storage. Since the food industry is concentrated on preservation of land food products such as meats, dairy and vegetables, there remains a need in the industry for low-cost, effective preservation of bulk food products such as bulk grains and related byproducts. According to the present invention, bulk food products can include bulk grains, animal feed and related byproducts. Examples of such bulk grains include, but are not limited to, wheat, corn, soybeans, barley, oats, and any other cereal grain that deteriorates in storage.

Examples of other oxidizable and highly reactive solid bulk materials embodied in the present invention include, but are not limited to, sulfide ores and carbon-containing materials, such as activated carbon and carbon black.

Oxidative deterioration, as used herein, generally refers to the undesired and uncontrolled reaction of the bulk material with oxygen in the ambient environment. This oxidation is undesirable because it consumes or reduces the energy available in the bulk material. In addition to degrading the energy potential of the material, the oxidative deterioration of bulk material raises the temperature of the bulk material, increasing the risk of spontaneous combustion. Furthermore, a typical feature of combustion processes such as oxidative deterioration is the production of water, which is undesirable because it creates material handling problems. Where the bulk material is to be burned, the energy available for use is reduced by the presence of water because of the large amount of energy consumed in vaporizing the water.

In addition to the tendency of bulk materials such as coal, lignite, and other organic materials to oxidize while held in storage, a feature of such materials is that aggregate amounts contain voids through which air may pass. This is because bulk materials consist of individual particles of various sizes surrounded by interstitial void spaces. Air infiltrates the bulk material from the surrounding atmosphere through these interstitial void spaces. Air provides the oxygen necessary for the oxidation process to proceed.

Reducing the volume of the void space and making the paths through the interstitial void spaces more tortuous increases the resistance to flow, thus reducing the flow rate. This in turn reduces the amount of oxygen available for contact with the bulk material, reducing the rate of oxidation. Beneficial reductions in the volume of the void space and increases in the tortuousness of the pathways between individual particles of the bulk material may be gained through careful control of the particle size distribution of the bulk material.

The particle size distribution is the relative percentage of fine and coarse particles in the bulk material. An ideal particle size distribution provides sufficient quantity of fine particles to fill the void spaces surrounding coarse particles. Therefore, the remaining void space is reduced when compared with, for example, bulk material having a uniform particle size, and the tortuousness of the pathways formed in the void space is increased. The quantity of fine particles necessary to fill the void spaces depends on the particle shape and the degree to which the particles nest together.

Many materials produced by standard crushing, grinding or pulverization processes do not generate advantageous ratios of fine particles to coarse particles so as to minimize the void space and air flow rate through the material. However, specific size classification and size reduction processes can be employed to generate a bulk material with an advantageous particle size distribution that results in a bulk material that is more resistant to air infiltration.

The method and composition disclosed herein describe advantageous amounts of void space as a percent of the total volume of the bulk material ("porosity"), and discloses means by which such advantageous characteristics can easily and economically be attained. In describing advantageous particle size distributions, it is convenient to make reference to a bi-modal particle size distribution. A bi-modal size distribution is characterized by material having two discontinuous particle size ranges. Thus, for example, a bulk material having a bi-modal particle size distribution might have a first particle size range of minus 4 mesh, and a second particle size range of ½ inch by 2 inches. Another way to describe a bi-modal size distribution is with reference to a graph plotting the total weight of particles having a certain particle size against the particle size. Where the particle size distribution is bi-modal, such a graph will be characterized by two discrete areas under a curve, each generally having a gaussian shape.

The present method includes sizing a first amount of the bulk material to a first size fraction and sizing a second amount of the bulk material to a second size fraction. The prepared first and second size fractions are then combined in proportion such that the resulting porosity of the bulk material is about 40% or less. Porosity, as used herein, generally refers to the void space within the volume of bulk material. Therefore, a volume of material having a porosity of 40% or less is comprised of the bulk material in an amount of 60% or more of the total volume, and a void or open space of 40% or less. In preferred embodiments, the resulting porosity is about 30% or less, and most preferably about 20% or less.

In one embodiment of the method of the present invention, the steps of sizing the bulk material may be achieved through crushing or grinding the material. Such crushing or grinding may preferably be performed at the site where the bulk material is produced, e.g., at a mine. In a further preferred embodiment, the bulk material may consist of coal, upgraded coal products, oil shale, solid biomass materials, refuse derived fuels, coke, char, petroleum coke, gilsonite, distillation byproducts, wood byproduct wastes, shredded tires, peat and waste pond coal fines.

In another embodiment, the step of preparing a first size fraction of the bulk material comprises preparing a first size fraction of from about ½ inch to about 2 inch particle size, and preparing a second size fraction of less than about 4 mesh particle size. For example, the bulk material, such as a bulk fuel material, may be recovered such that the size of its particles are less than about 2 inches, or crushed such that the size of its particles is less than about 2 inches. From this bulk material, a first fraction of from about ½ inch to about 2 inch particle size is recovered. A second fraction of about less than 4 mesh particle size is also recovered. Finally, a third fraction of from about ½ inch to about 4 mesh particle size is recovered. Then, the third recovered fraction is crushed to a particle size of less than 4 mesh. The resulting first, second and third fractions of material are then combined, resulting in a bulk fuel material preferably having a porosity of 40% or less, more preferably having a porosity of 30% or less, and most preferably having a porosity of 20% or less.

The above-described steps of recovering first, second and third size fractions may be performed using screens to size the bulk fuel material. An example of such a sorting technique is as follows: Coal is recovered from a deposit and crushed to a particle size of about 2 inches or less. The coal is then passed over a first screen or mesh that allows particles of less than about 2 inches to pass through the screen or mesh, and directs particles of larger than about 2 inches to a storage container. The material that is less than 2 inches in particle size is then passed over a second screen having a size of 4 mesh. This second screen thus allows material having a particle size of less than about 4 mesh to pass through. The material that passes through the second screen is then combined with the material rejected by the first screen having a particle size of greater than about 2 inches.

The material of size greater than about 4 mesh that is rejected by the second screen is crushed a second time to a size of less than about 4 mesh. The bulk fuel material from the second crushing step is then combined with the previously sorted material having a particle size of greater than about 2 inches and that having a particle size of less than about 4 mesh. The resulting aggregate of bulk material preferably has a porosity of about 40% or less, more preferably 30% or less, and most preferably 20% or less.

In addition to the porosity of 40% or less achieved by the described method, the bulk material so produced is further characterized by having a bi-modal size distribution. This bi-modal size distribution features a first amount of bulk material having a relatively large number of particles of about 2 inches in size, and a second amount of bulk material having a relatively large number of particles of about less than 4 mesh size. This bimodal size distribution increases the packing density of the bulk material, concomitantly reducing the porosity of the material in aggregate, increasing the aggregate density of the material, and making the pathways through the interstitial void space in the material more tortuous.

In another embodiment, the disclosed method includes contacting the bulk material with an inert gas. Such contact with an inert gas further reduces the oxidative deterioration of the bulk material by displacing oxygen that might otherwise be in contact with the bulk material. The inert gas also may react with the surface of the bulk material to passivate the material from oxidation by the ambient air. Therefore, a preferred embodiment of the present invention is one in which a bulk material has been sized and sorted to attain a porosity of 40% or less, and then contacted with an inert gas. Contacting with an inert gas may be accomplished by introducing the inert gas into the interior of the storage pile, such as by inserting a pipe or other distribution device into the storage pile at various points throughout the pile and injecting an appropriate amount of inert gas.

Another preferred embodiment includes the step of contacting the bulk material with a heat transfer medium, and cooling the bulk material to below about 10° C. More preferably, the step of contacting the bulk material with a heat transfer medium includes cooling the bulk material to below about 5° C. In a further preferred embodiment, the step of contacting the first and second size fractions of the bulk material with a heat transfer medium includes cooling the bulk material to between about 0° C. and about 3° C. With respect to the use of a heat transfer medium in connection with any of the processes described herein, reference is made to U.S. Pat. No. 5,725,613 to Reeves et al., which issued on Mar. 10, 1998. The disclosure made in U.S. Pat. No. 5,725,613, which shares the same assignee as does the present disclosure, is specifically incorporated herein by reference.

In embodiments of the present invention in which the bulk material is fuel, an important advantage of the invention is that reductions in oxidative deterioration of the fuel material correspond to reductions in the loss of heating value of the fuel. For example, in an additional preferred embodiment, where the bulk material in question is a fuel, the bulk fuel material loses less than about 5% of its heating value over a period of 9 days, more preferably less than about 3%, and most preferably less than about 1%.

In one embodiment of the present method, bulk material prepared according to the method described above is aggregated into a pile for storage until the bulk material is ready for use. Bulk material so prepared is advantageous when stored as compared to bulk material prepared using standard methods, because the reduced porosity of the bulk material reduces the oxidative deterioration of the bulk material. In addition, the reduced porosity results in a reduced overall volume of the bulk material, reducing the amount of storage space required.

As noted above, material prepared in accordance with the above-described method may comprise coal, and in particular, bituminous coal, sub-bituminous coal or lignite. Where the bulk fuel material is lignite, the density of the bulk fuel material after processing according to the present method will preferably be approximately 40 lbs./ft$^3$ of material or greater, more preferably about 50 lbs./ft$^3$or greater, and most preferably about 55 lbs./ft$^3$ or greater.

The present invention also includes reducing the oxidative deterioration of a bulk material by aggregating an amount of the bulk material into a pile, and introducing a combination of at least two inert gases into the pile, wherein the proportion of the inert gases provides a density to maintain a stable mass of the composition within the pile. In order to ensure such a stable mass, the mass per unit volume of the selected inert gases should preferably differ, allowing the density of the resulting combination of inert gases to be adjusted by providing the inert gases in varying proportions. Thus, where the temperature of the pile is higher than that of the ambient air, the relative proportion of the heavier inert gas or gases is advantageously increased, to prevent the inert gas combination from flowing out the top of the pile. Where the temperature of the pile is less than that of the ambient air, the relative proportion of the lighter inert gas or gases is advantageously increased, to prevent the inert gas combination from flowing out the bottom of the pile. In particular embodiments of this method, the inert gases may be selected from the group consisting of flue gas, carbon dioxide, carbon monoxide, nitrogen and argon.

In another embodiment, the present invention also includes a method to reduce oxidative deterioration of a bulk material comprising aggregating an amount of the bulk material into a pile. The ambient air temperature and the temperature of the bulk material is then determined, and a composition is prepared that comprises at least two inert gases having a density at the temperature of the bulk material that approximates the density of the air at the ambient air temperature. This composition of inert gases is then introduced into the pile. This method ensures that the inert gas will remain in contact with the bulk material for an effective period of time, reducing oxidation of the material in the pile. The inert gases may be introduced into the pile by, for example, inserting a pipe or other distribution device into various points throughout the storage pile and injecting an appropriate amount of the composition of inert gases. In one embodiment of the present invention, the inert gases are selected from the group consisting of flue gas, carbon dioxide, carbon monoxide, nitrogen and argon. In another embodiment of the invention, the inert gases comprise flue gas, carbon dioxide and nitrogen.

The following example is provided for purposes of illustration only and is not intended to limit the scope of the invention.

EXAMPLES

Example 1

This example evaluates the resistance to airflow that is achieved using varying particle size distributions of lignite.

An experiment was conducted to demonstrate how lignite, a common bulk material susceptible to oxidation, can be made more resistant to airflow by modifying the particle size distribution. The experiment compared air flow rate through a volume of lignite crushed by standard methods with lignite processed by special size classification and size reduction methods. The size distribution of the standard and modified lignite samples is summarized in Table 1.

TABLE 1

Size Distribution of Minus 25-mm Lignite Samples Direct Weight Percent

| Size Fraction | Standard Product | Modified Product |
|---|---|---|
| 25 mm × 6 mm | 52% | 33% |
| 6 mm × 2 mm | 25% | 25% |
| 2 mm × 0 mm | 23% | 42% |

The standard and modified products were placed in a chamber pressurized with air. The flow rate of air moving through the samples was measured and recorded. Results, summarized in Table 2, show that the modified product is more resistant to airflow than the standard product. The difference becomes even greater at higher pressures.

TABLE 2

Airflow Through Standard and Modified Lignite (Liters per Minute)

| Air Pressure, inches water column | Standard Product | Modified Product |
|---|---|---|
| 2 | 4.5 | 3.6 |
| 5 | 10.4 | 9.1 |
| 10 | 15.0 | 13.5 |

While various embodiments of the present invention have been described in detail, it is apparent that modifications and adaptations of those embodiments will occur to those skilled in the art. It is to be expressly understood, however, that such modifications and adaptations are within the scope of the present invention, as set forth in the following claims.

What is claimed is:

1. A method to reduce oxidative deterioration of a bulk fuel material, the method comprising the steps of:

sizing a first amount of the bulk fuel material to a first size fraction;

sizing a second amount of the bulk fuel material to a second size fraction;

sizing a third amount of the bulk fuel material to a third size fraction;

reducing a particle size of said third size fraction to said second size fraction; and combining the first second and third amounts of the bulk fuel material to attain a resulting porosity of the bulk fuel material of about 40% or less.

2. A method, as claimed in claim 1, wherein the sizing steps comprise crushing the bulk fuel material.

3. A method, as claimed in claim 1, wherein the sizing steps are performed at the place where the bulk fuel material is produced.

4. A method, as claimed in claim 1, wherein the bulk fuel material is selected from the group consisting of coal, upgraded coal products, oil shale, solid biomass materials, refuse-derived fuels, coke, char, petroleum coke, gilsonite, distillation by-products, wood by-product wastes, shredded tires, peat and waste pond coal fines.

5. A method, as claimed in claim 1, wherein the first size fraction has a particle size of from about ½ inch to about 2 inch, and wherein the second size fraction has a particle size of less than about 4 mesh.

6. A method, as claimed in claim 1, further comprising the step of:

contacting the combined first and second amounts with an inert gas.

7. A method, as claimed in claim 1, further comprising the step of: contacting the combined first and second amounts with a heat transfer medium to cool the bulk fuel material to below about 10° C.

8. A method, as claimed in claim 1, further comprising the step of:

contacting the combined first and second amounts with a heat transfer medium to cool the bulk fuel material to below about 5° C.

9. A method, as claimed in claim 1, further comprising the step of:

contacting the combined first and second amounts with a heat transfer medium to cool the bulk fuel material to between about 0° C. and about 3° C.

10. A method, as claimed in claim 1, wherein the bulk fuel material loses less than about 3% of its heating value over a period of 9 days.

11. A method, as claimed in claim 1, wherein the bulk fuel material comprises coal, and wherein the coal is selected from the group consisting of bituminous coal, sub-bituminous coal and lignite.

12. A method to reduce oxidative deterioration of a bulk fuel material having a particle size of less than about 2 inches, the method comprising the steps of:

recovering a first fraction of the bulk fuel material having a particle size of about ½ inch to about 2 inch;

recovering a second fraction of the bulk fuel material having a particle size of less than about 4 mesh;

recovering a third fraction of the bulk fuel material having a particle size of about ½ inch to about 4 mesh;

crushing the third fraction to a particle size of less than about 4 mesh;

combining the first, second and third fractions.

13. A method, as claimed in claim 12, further comprising the step of aggregating the bulk fuel material into a storage pile.

14. A method as claimed in claim 12, wherein the bulk fuel material comprises lignite and the combined first, second and third fractions of the lignite have a density of greater than 40 pounds per cubic foot.

15. A method as claimed in claim 12, wherein the bulk fuel material comprises coal, and wherein the coal is selected from the group consisting of bituminous coal, sub-bituminous coal and lignite.

16. A method, as claimed in claim 12, wherein the bulk fuel material is selected from the group consisting of coal upgraded coal products, oil shale, solid biomass materials, refuse-derived fuels, coke, char, petroleum coke, gilsonite, distillation by-products, wood by-product wastes, shredded tires, peat and waste pond coal fines.

17. A method, as claimed in claim 12, further comprising the step of:

contacting the combined first, second and third fractions with an inert gas.

18. A method, as claimed in claim 12, further comprising the step of:

contacting the combined first, second and third fractions with a heat transfer medium to cool the bulk fuel material to below about 10° C.

19. A method, as claimed in claim 12, further comprising the step of:

contacting the combined first, second and third fractions with a heat transfer medium to cool the bulk fuel material to below about 5° C.

20. A method, as claimed in claim 12, further comprising the step of:

contacting the combined first, second and third fractions with a heat transfer medium to cool the bulk fuel material to between about 0° C. and about 3° C.

21. A method, as claimed in claim 12, wherein the bulk fuel material loses less than about 3% of its heating value over a period of 9 days.

22. A method to reduce oxidative deterioration of a bulk fuel material, the method comprising the steps of:

providing a bulk fuel material having a bi-modal particle size distribution to achieve a porosity of the bulk fuel material of about 40% or less; and aggregating the bulk fuel material having a porosity of 40% or less into a storage pile, wherein said bulk fuel material has a density of 40 pounds per cubic foot or greater.

23. A method as claimed in claim 22, wherein said step of providing a bulk fuel material having a particle size distribution to achieve a porosity of the bulk fuel material of about 40% or less comprises the steps of:

sizing a first amount of the bulk fuel material to a first size fraction;

sizing a second amount of the bulk fuel material to a second size fraction; and combining the first and second amounts of the bulk fuel material to attain said porosity of the bulk fuel material of about 40% or less.

24. A method as claimed in claim 23, wherein the sizing steps comprise crushing the bulk fuel material.

25. A method as claimed in claim 23, wherein the sizing steps are performed at the place where the bulk fuel material is produced.

26. A method as claimed in claim 22, wherein the bulk fuel material is selected from the group consisting of coal, upgraded coal products, oil shale, solid biomass materials, refuse-derived fuels, coke, char, petroleum coke, gilsonite, distillation by-products, wood by-product wastes, shredded tires, peat and waste pond coal fines.

27. A method, as claimed in claim 23, wherein the first size fraction has a particle size of from about ½ inch to about 2 inch, and wherein the second size fraction has a particle size of about −4 mesh.

28. A method, as claimed in claim 22, further comprising the step of:

contacting the bulk fuel material with an inert gas.

29. A method, as claimed in claim further comprising the step of:

contacting bulk fuel material with a heat transfer medium to cool the bulk fuel material to below about 10° C.

30. A method, as claimed in claim 22, further comprising the step of:

contacting the bulk fuel material with a heat transfer medium to cool the bulk fuel material to below about 5° C.

31. A method, as claimed in claim 22, further comprising the step of:

contacting the bulk fuel material with a heat transfer medium to cool the bulk fuel material to between about 0° C. and about 3° C.

32. A method, as claimed in claim 22, wherein the bulk fuel material is a fuel material and loses less than about 3% of its heating value over a period of 9 days.

33. A method, as claimed in claim 22, wherein the bulk fuel material comprises coal, and wherein the coal is selected from the group consisting of bituminous coal, sub-bituminous coal and lignite.

34. A bulk fuel material having a bi-modal particle size distribution to achieve a porosity of the bulk fuel material of about 40% or less and having a density of about 40 pounds per cubic foot or greater.

35. A bulk fuel material, as claimed in claim 34, wherein said bi-modal particle size distribution can include material that can be divided into three particle size fractions wherein each of the largest and smallest of the size fractions constitutes a greater weight percentage of the total bulk fuel material than the intermediate size fractions.

36. A bulk fuel material, as claimed in claim 34, wherein a graph having an x-axis representing particle size and a y-axis representing weight percent of said bulk fuel material is characterized by having two local maxima.

37. A bulk fuel material, as claimed in claim 34, wherein the bulk fuel material comprises lignite and wherein the bulk fuel material has a density of 40 $lb/ft^3$ or greater.

38. A bulk fuel material, as claimed in claim 34, wherein the bulk fuel material is coal.

39. A bulk fuel material, as claimed in claim 38, wherein the coal is selected from the group consisting of bituminous coal, sub-bituminous coal and lignite.

40. A composition of a bulk fuel material, comprising a first amount of the bulk fuel material having a first particle size range combined with a second amount of the bulk fuel material having a second particle size range, wherein the first and second particle size ranges are discontinuous and wherein the combination of the first and second amounts has a porosity of 40% or less, wherein said bulk fuel material has a density of about 55 pounds per cubic foot or greater.

41. A composition of a bulk fuel material, as claimed in claim 40, wherein the bulk fuel material is coal.

42. A composition of a bulk fuel material, as claimed in claim 41, wherein the coal is selected from the group consisting of bituminous coal, sub-bituminous coal and lignite.

* * * * *

UNITED STATES PATENT AND TRADEMARK OFFICE

CERTIFICATE OF CORRECTION

PATENT NO. : 6,231,627 B1
DATED : May 15, 2001
INVENTOR(S) : Reeves, et al.

It is certified that error appears in the above-identified patent and that said Letters Patent is hereby corrected as shown below:

Claim 29,
Line 1, following "claim", please insert -- 22 --.

Signed and Sealed this

Fourth Day of December, 2001

*Attest:*

Nicholas P. Godici

NICHOLAS P. GODICI
*Acting Director of the United States Patent and Trademark Office*

*Attesting Officer*